US007575733B2

(12) United States Patent
Fischer et al.

(10) Patent No.: US 7,575,733 B2
(45) **Date of Patent: *Aug. 18, 2009**

(54) PLASMA-TREATED CARBON FIBRILS AND METHOD OF MAKING SAME

(75) Inventors: Alan Fischer, Cambridge, MA (US); Robert Hoch, Hensonville, NY (US)

(73) Assignee: Hyperion Catalysis International, Inc., Cambridge, MA (US)

( * ) Notice: Subject to any disclaimer, the term of this patent is extended or adjusted under 35 U.S.C. 154(b) by 146 days.

This patent is subject to a terminal disclaimer.

(21) Appl. No.: 11/841,539

(22) Filed: Aug. 20, 2007

(65) Prior Publication Data

US 2007/0280875 A1 Dec. 6, 2007

Related U.S. Application Data

(63) Continuation of application No. 10/910,927, filed on Aug. 4, 2004, now Pat. No. 7,498,013, which is a continuation of application No. 08/715,027, filed on Sep. 17, 1996, now abandoned.

(51) Int. Cl.
*D01F 9/12* (2006.01)

(52) U.S. Cl. ..... 423/447.1; 423/460

(58) Field of Classification Search ..... 423/460, 423/447.1

See application file for complete search history.

(56) References Cited

U.S. PATENT DOCUMENTS 5,879,836 A * 3/1999 Ikeda et al. ..... 429/231.8

* cited by examiner

*Primary Examiner*—Stuart Hendrickson
(74) *Attorney, Agent, or Firm*—Kramer Levin Naftalis & Frankel LLP; Barry Evans, Esq.

(57) ABSTRACT

A method of treating carbon fibrils and carbon fibril structures such as assemblages, aggregates and hard porous structures with a plasma to effect an alteration of the surface or structure of the carbon fibril or fibrils. The method can be utilized to functionalize, prepare for functionalization or otherwise modify the fibril surface via a "dry" chemical process.

1 Claim, No Drawings

PLASMA-TREATED CARBON FIBRILS AND METHOD OF MAKING SAME

This application is a continuation of U.S. Ser. No. 10/910,927, filed Aug. 4, 2004 which is a continuation of U.S. Ser. No. 08/715,027, filed Sep. 17, 1996 which is now abandoned, each of which are hereby incorporated by reference in its entirety.

FIELD OF THE INVENTION

The invention relates generally to plasma treatment of carbon fibrils, including carbon fibril structures (i.e., an interconnected multiplicity of carbon fibrils). More specifically, the invention relates to surface-modification of carbon fibrils by exposure to a cold plasma (including microwave or radio frequency generated plasmas) or other plasma. Surface modification includes functionalizing, preparation for functionalizing, preparation for adhesion or other advantageous modification of carbon fibrils or carbon fibril structures.

BACKGROUND OF THE INVENTION

This invention lies in the field of the treatment of submicron graphitic fibrils, sometimes called vapor grown carbon fibers. Carbon fibrils are vermicular carbon deposits having diameters less than 1.0μ, preferably less than 0.5μ, and even more preferably less than 0.2μ. They exist in a variety of forms and have been prepared through the catalytic decomposition of various carbon-containing gases at metal surfaces. Such vermicular carbon deposits have been observed almost since the advent of electron microscopy. A good early survey and reference is found in Baker and Harris, *Chemistry and Physics of Carbon*, Walker and Thrower ed., Vol. 14, 1978, p. 83, hereby incorporated by reference. See also, Rodriguez, N., *J. Mater. Research*, Vol. 8, p. 3233 (1993), hereby incorporated by reference.

In 1976, Endo et al. (see Obelin, A. and Endo, M., *J. of Crystal Growth*, Vol. 32 (1976), pp. 335-349, elucidated the basic mechanism by which such carbon fibrils grow. There were seen to originate from a metal catalyst particle which, in the presence of a hydrocarbon containing gas, becomes supersaturated in carbon. A cylindrical ordered graphitic core is extruded which immediately, according to Endo et al., becomes coated with an outer layer of pyrolytically deposited graphite. These fibrils with a pyrolytic overcoat typically have diameters in excess of 0.1μ, more typically 0.2 to 0.5μ.

In 1984, Tennent, U.S. Pat. No. 4,663,230, succeeded in growing cylindrical ordered graphite cores, uncontaminated with pyrolytic carbon. Thus, the Tennent invention provided access to smaller diameter fibrils, typically 35 to 700 Å (0.0035 to 0.070μ) and to an ordered, "as grown" graphitic surface. Fibrillar carbons of less perfect structure, but also without a pyrolytic carbon outer layer have also been grown. These carbon fibrils are free of a continuous thermal carbon overcoat, i.e., pyrolytically deposited carbon resulting from thermal cracking of the gas feed used to prepare them, and have multiple graphitic outer layers that are substantially parallel to the fibril axis. As such they may be characterized as having their c-axes, the axes which are perpendicular to the tangents of the curved layers of graphite, substantially perpendicular to their cylindrical axes. They generally have diameters no greater than 0.1μ and length to diameter ratios of at least 5.

The fibrils (including without limitation to buckytubes and nanofibers), treated in this application are distinguishable from continuous carbon fibers commercially available as reinforcement materials. In contrast to carbon fibrils, which have desirably large but unavoidably finite aspect ratios, continuous carbon fibers have aspect ratios (L/D) of at least $10^4$ and often $10^6$ or more. The diameter of continuous fibers is also far larger than that of fibrils, being always >1.0μ and typically from 5 to 7μ.

Tennent, et al., U.S. Pat. No. 5,171,560, describes carbon fibrils free of thermal overcoat and having graphitic layers substantially parallel to the fibril axes such that the projection of said layers on said fibril axes extends for a distance of at least two fibril diameters. Typically, such fibrils are substantially cylindrical, graphitic nanotubes of substantially constant diameter and comprise cylindrical graphitic sheets whose c-axes are substantially perpendicular to their cylindrical axis. They are substantially free of pyrolytically deposited carbon, and have a diameter less than 0.1μ and a length to diameter ratio of greater than 5.

Carbon nanotubes of a morphology similar to the catalytically grown fibrils described above have been grown in a high temperature carbon arc (Iijima, Nature 354 56 1991). It is now generally accepted (Weaver, Science 265 1994) that these arc-grown nanofibers have the same morphology as the earlier catalytically grown fibrils of Tennent. Arc grown carbon nanofibers are also useful in the invention.

Moy et al., U.S. application Ser. No. 07/887,307 filed May 22, 1992, hereby incorporated by reference, describes fibrils prepared as aggregates having various macroscopic morphologies (as determined by scanning electron microscopy) in which they are randomly entangled with each other to form entangled balls of fibrils resembling bird nests ("BN"); or as aggregates consisting of bundles of straight to slightly bent or kinked carbon fibrils having substantially the same relative orientation, and having the appearance of combed yarn ("CY") e.g., the longitudinal axis of each fibril (despite individual bends or kinks) extends in the same direction as that of the surrounding fibrils in the bundles; or as aggregates consisting of bundles of straight to slightly bent or kinked carbon fibrils having a variety of relative orientation, and having the appearance of cotton candy ("CC"); or, as, aggregates consisting of straight to slightly bent or kinked fibrils which are loosely entangled with each other to form an "open net" ("ON") structure. In open net structures the degree of fibril entanglement is greater than observed in the combed yarn aggregates (in which the individual fibrils have substantially the same relative orientation) but less than that of bird nests. CY and ON aggregates are more readily dispersed than BN making them useful in composite fabrication where uniform properties throughout the structure are desired.

When the projection of the graphitic layers on the fibril axis extends for a distance of less than two fibril diameters, the carbon planes of the graphitic nanofiber, in cross section, take on a herring bone appearance. These are termed fishbone ("FB") fibrils. Geus, U.S. Pat. No. 4,855,091, provides a procedure for preparation of fishbone fibrils substantially free of a pyrolytic overcoat. These fibrils are also useful in the practice of the invention.

Further details regarding the formation of carbon fibril aggregates may be found in the disclosure of Snyder et al., U.S. patent application Ser. No. 149,573, filed Jan. 28, 1988, and PCT application No. US89/00322, filed Jan. 28, 1989 ("Carbon Fibrils") WO 89/07163, and Moy et al., U.S. patent application Ser. No. 413,837 filed Sep. 28, 1989 and PCT application No. US90/05498, filed Sep. 27, 1990 ("Fibril Aggregates and Method of Making Same") WO 91/05089, all of which are assigned to the same assignee as the reference invention.

Pending provisional application Ser. No. 60/020,804 ("'804"), here incorporated by reference, describes rigid porous carbon structures of fibrils or fibril aggregates having highly accessible surface area substantially free of micropores. '804 relates to increasing the mechanical integrity and/or rigidity of porous structures comprising intertwined carbon fibrils. Structures made according to '804 have higher crush strengths than conventional fibril structures. '804 provides a method of improving the rigidity of the carbon structures by causing the fibrils to form bonds or become glued with other fibrils at fibril intersections. The bonding can be induced by chemical modification of the surface of the fibrils to promote bonding, by adding "gluing" agents and/or by pyrolyzing the fibrils to cause fusion or bonding at the interconnect points.

As mentioned above, the fibrils can be in discrete form or aggregated. The former results in the exhibition of fairly uniform properties. The latter results in a macrostructure comprising component fibril particle aggregates bonded together and a microstructure of intertwined fibrils.

Pending application Ser. No. 08/057,328, here incorporated by reference, describes a composition of matter consisting essentially of a three-dimensional, macroscopic assemblage of a multiplicity of randomly oriented carbon fibrils, said fibrils being substantially cylindrical with a substantially constant diameter, having c-axes substantially perpendicular to their cylindrical axis, being substantially free of pyrolytically deposited carbon and having a diameter between about 3.5 and 70 nanometers, said assemblage having a bulk density of from 0.001 to 0.50 gm/cc. Preferably the assemblage has relatively or substantially uniform physical properties along at least one dimensional axis and desirably have relatively or substantially uniform physical properties in one or more planes within the assemblage, i.e. they have isotropic physical properties in that plane. The entire assemblage may also be relatively or substantially isotropic with respect to one or more of its physical properties.

McCarthy et al., U.S. patent application Ser. No. 351,967 filed May 15, 1989, hereby incorporated by reference, describes processes for oxidizing the surface of carbon fibrils that include contacting the fibrils with an oxidizing agent that includes sulfuric acid ($H_2SO_4$) and potassium chlorate ($KClO_3$) under reaction conditions (e.g., time, temperature, and pressure) sufficient to oxidize the surface of the fibril. The fibrils oxidized according to the processes of McCarthy, et al. are non-uniformly oxidized, that is, the carbon atoms are substituted with a mixture of carboxyl, aldehyde, ketone, phenolic and other carbonyl groups. McCarthy and Bening (Polymer Preprints ACS Div. of Polymer Chem. 30 (1)420 (1990)).

Fibrils have also been oxidized non-uniformly by treatment with nitric acid. International Application PCT/US94/10168, hereby incorporated by reference, discloses the formation of oxidized fibrils containing a mixture of functional groups. Hoogenvaad, M. S., et al. ("Metal Catalysts supported on a Novel Carbon Support", Presented at Sixth International Conference on Scientific Basis for the Preparation of Heterogeneous Catalysts, Brussels, Belgium, September 1994), hereby incorporated by reference, also found it beneficial in the preparation of fibril-supported precious metals to first oxidize the fibril surface with nitric acid. Such pretreatment with acid is a standard step in the preparation of carbon-supported noble metal catalysts, where, given the usual sources of such carbon, it serves as much to clean the surface of undesirable materials as to functionalize it.

While many uses have been found for carbon fibrils and aggregates of carbon fibrils, including non-functionalized and functionalized fibrils as described in the patents and patent applications referred to above, there is still a need for technology enabling convenient and effective functionalization or other alteration of carbon fibril surfaces, and for a fibril with a surface so treated.

OBJECTS OF THE INVENTION

It is therefore a primary object of this invention to provide a method of treating carbon fibrils with a plasma to achieve a chemical alteration of the surfaces of the carbon fibrils treated.

It is yet another object of this invention to provide a method of oxidizing carbon fibrils and carbon fibril structures by conducting plasma treatment in the presence of oxygen or an oxygen-containing material.

It is still another object of this invention to provide a method of introducing nitrogen-containing functional groups into carbon fibrils and carbon fibril structures by conducting plasma treatment in the presence of a nitrogen-containing material.

It is further and related an object of this invention to provide a method of treating carbon fibrils and carbon fibril structures in preparation for subsequent oxidation, nitrogenation, fluorination or other functionalization.

It is yet another object of this invention to provide a "dry" method of treating or functionalizing carbon fibrils.

It is further still an object of this invention to provide plasma-treated fibrils and fibril structures having modified surface characteristics.

SUMMARY OF THE INVENTION

The invention encompasses methods of producing carbon fibrils, and carbon fibril structures such as assemblages, aggregates and hard porous structures, including functionalized fibrils and fibril structures, by contacting a fibril, a plurality of fibrils or one or more fibril structures with a plasma. Plasma treatment, either uniform or non-uniform, effects an alteration (chemical or otherwise) of the surface of a fibril or fibril structure and can accomplish functionalization, preparation for functionalization and many other modifications, chemical or otherwise, of fibril surface properties, to form, for example, unique compositions of matter with unique properties, and/or treated surfaces within the framework of a "dry" chemical process.

Thus, in one of its aspects the invention is a method for chemically modifying the surface of a carbon fibril, comprising the step of exposing said fibril to a plasma.

In another of its aspects the invention is a modified carbon fibril the surface of which has been altered by contacting same with a plasma.

In yet another of its aspects the invention is a modified carbon fibril structure constituent fibrils of which have had their surfaces altered by contacting same with a plasma.

DESCRIPTION OF CERTAIN PREFERRED EMBODIMENTS OF THE INVENTION

A preferred embodiment of the inventive method comprises a method for chemically modifying the surface of one or more carbon fibrils, comprising the steps of: placing said fibrils in a treatment vessel; and contacting said fibrils with a plasma within said vessel for a predetermined period of time.

An especially preferred embodiment of the inventive method comprises a method for chemically modifying the surface of one or more carbon fibrils, comprising the steps of placing said fibrils in a treatment vessel; creating a low pressure gaseous environment in said treatment vessel; and generating a plasma in said treatment vessel, such that the plasma is in contact with said material for a predetermined period of time.

Treatment can be carried out on individual fibrils,as well as on fibril structures such as aggregates, mats, hard porous fibril structures, and even previously functionalized fibrils or fibril structures. Surface modification of fibrils can be accomplished by a wide variety of plasmas, including those based on $F_2$, $O_2$, $NH_3$, He, $N_2$ and $H_2$, other chemically active or inert gases, other combinations of one or more reactive and one or more inert gases or gases capable of plasma-induced polymerization such as methane, ethane or acetylene. Moreover, plasma treatment accomplishes this surface modification in a "dry" process (as compared to conventional "wet" chemical techniques involving solutions, washing, evaporation, etc.). For instance, it may be possible to conduct plasma treatment on fibrils dispersed in a gaseous environment.

Once equipped with the teachings herein, one of ordinary skill in the art will be able to practice the invention utilizing well-known plasma technology (without the need for further invention or undue experimentation). The type of plasma used and length of time plasma is contacted with fibrils will vary depending upon the result sought. For instance, if oxidation of the fibrils' surface is sought, an $O_2$ plasma would be used, whereas an ammonia plasma would be employed to introduce nitrogen-containing functional groups into fibril surfaces. Once in possession of the teachings herein, one skilled in the art would be able (without undue experimentation) to select treatment times to effect the degree of alteration/functionalization desired.

More specifically, fibrils or fibril structures are plasma treated by placing the fibrils into a reaction vessel capable of containing plasmas. A plasma can, for instance, be generated by (1) lowering the pressure of the selected gas or gaseous mixture within the vessel to, for instance, 100-500 mT, and (2) exposing the low-pressure gas to a radio frequency which causes the plasma to form. Upon generation, the plasma is allowed to remain in contact with the fibrils or fibril structures for a predetermined period of time, typically in the range of approximately 10 minutes (though in some embodiments it could be more or less depending on, for instance, sample size, reactor geometry, reactor power and/or plasma type) resulting in functionalized or otherwise surface-modified fibrils or fibril structures. Surface modifications can include preparation for subsequent functionalization.

Treatment of a carbon fibril or carbon fibril structure as indicated above results in a product having a modified surface and thus altered surface characteristics which are highly advantageous. The modifications can be a functionalization of the fibril or fibril structure (such as chlorination, fluorination, etc.), or a modification which makes the surface material receptive to subsequent functionalization (optionally by another technique), or other modification (chemical or physical) as desired.

This invention is further described in the following examples, though they are not to be considered in any way as limiting the invention.

EXAMPLE 1

Method of Plasma-Treating Carbon Fibrils

A carbon fibril mat is formed by vacuum filtration on a nylon membrane. The nylon membrane is then placed into the chamber of a plasma cleaner apparatus. The plasma cleaner is sealed and attached to a vacuum source until an ambient pressure of 40 milliTorr (mT) is achieved. A valve needle on the plasma cleaner is opened to air to achieve a dynamic pressure of approximately 100 mT. When dynamic pressure is stabilized, the radio frequency setting of the plasma cleaner is turned to the medium setting for 10 minutes to generate a plasma. The carbon fibrils are allowed to remain in the plasma cleaner for an additional 10 minutes after cessation of the radio frequency.

The sample of the plasma treated fibril mat is analyzed by electron spectroscopy for chemical analysis (ESCA) showing an increase in the atomic percentage of oxygen relative to carbon compared to an untreated control sample. Further, inspection of the carbon 1s (C 1s) peak of the ESCA spectrum, run under conditions of higher resolution, shows the presence of oxygen bonded in different ways to carbon including singly bonded as in alcohols or ethers, doubly bonded as in carbonyls or ketones or in higher oxidation states as carboxyl or carbonate. The deconvoluted C 1s peak shows the relative abundance of carbon in the different oxygen bonding modes. Further, the presence of an N 1s signal indicates the incorporation of N from the air plasma.

An analysis of the entire depth of the plasma treated fibril mat sample is analyzed by fashioning a piece of the sample into an electrode and looking at the shape of the cyclic voltammograms in $0.5MK_2SO_4$ electrolyte. A 3 mm by 5 mm piece of the fibril mat, still on the nylon membrane support, is attached at one end to a copper wire with conducting Ag paint. The Ag paint and the copper wire are covered with an insulating layer of epoxy adhesive leaving a 3 mm by 3 mm flag of the membrane supported fibril mat exposed as the active area of the electrode. Cyclic voltammograms are recorded in a three electrode configuration with a Pt wire gauze counter electrode and a Ag/AgCl reference electrode. The electrolyte is purged with Ar to remove oxygen before recording the voltammograms. An untreated control sample shows rectangular cyclic voltammogram recorded between −0.2 V vs Ag/AgCl and +0.8 V vs Ag/AgCl with constant current due only to the double layer capacitance charging and discharging of the high surface area fibrils in the mat sample. A comparably sized piece of the plasma treated fibril mat sample shows a large, broad peak in both the anodic and cathodic portions of the cyclic voltammogram overlaying the double layer capacitance charging and discharging observed in the control sample, and similar to the traces recorded with fibril mats prepared from fibrils that are oxidized by chemical means.

EXAMPLE 2

Plasma Treatment of Carbon Fibrils With a Fluorine-Containing Plasma

Fluorination of fibrils by plasma is effected using either fluorine gas or a fluorine containing gas, such as a volatile fluorocarbon like $CF_4$, either alone or diluted with an inert gas such as helium. The samples are placed in the chamber of the plasma reactor system and the chamber evacuated. The chamber is then backfilled with the treatment gas, such as 10% fluorine in helium, to the desired operating pressure under dynamic vacuum. Alternatively, a mass flow controller is used to allow a controlled flow of the treatment gas through the reactor. The plasma is generated by application of a radio signal and run for a fixed period of time. After the plasma is turned off the sample chamber is evacuated and backfilled with helium before the chamber is opened to remove the samples.

The sample of the plasma treated fibrils is analyzed by standard elemental analysis to document the extent of incorporation of fluorine into the fibrils.

Electron spectroscopy for chemical analysis (ESCA) is also used to analyze the sample for fluorine incorporation by measuring the F 1s signal relative to the C 1s signal. Analysis of the shape of the C 1s signal recorded under conditions of higher resolution is used to examine the fluorine incorporation pattern (e.g., —CF, —$CF_2$, —$CF_3$).

EXAMPLE 3

Plasma Treatment of Carbon Fibrils With a Nitrogen-Containing Plasma

A fibril mat sample is treated in an ammonia plasma to introduce amine groups. The samples are placed in the chamber of the plasma reactor system and the chamber evacuated. The chamber is then backfilled with anhydrous ammonia to the desired operating pressure under dynamic vacuum. Alternatively, a mass flow controller is used to allow a controlled flow of the ammonia gas through the reactor under dynamic vacuum. The plasma is generated by application of a radio signal and controlled and run for a fixed period of time after which time the plasma is "turned off". The chamber is then evacuated and backfilled with helium before the chamber is opened to remove the sample.

Alternatively, a mixture of nitrogen and hydrogen gases in a controlled ratio is used as the treatment gas to introduce amine groups to the fibril sample.

The sample of the plasma treated fibril mat is analyzed by standard elemental analysis to demonstrate incorporation of nitrogen and the C:N ratio. Kjeldahl analysis is used to detect low levels of incorporation.

In addition, the sample of the plasma treated fibril mat is analyzed by electron spectroscopy for chemical analysis (ESCA) to indicate the incorporation of nitrogen into the fibril material. The presence and magnitude of the N 1s signal indicates incorporation of nitrogen and the atomic percentage relative to the other elements in the fibril material. The N 1s signal indicates the incorporation of nitrogen in all forms. ESCA is also used to measure the incorporation of primary amine groups specifically by first reacting the plasma treated fibril mat sample with pentafluorobenzaldehyde (PFB) vapor to form complexes between the PFB and primary amine groups on the sample and using ESCA to quantitate the fluorine signal.

Applicants, having thus described in detail preferred embodiments of the present invention, it is to be understood that the invention defined by the appended claims is not to be limited by particular details set forth in the above description as many apparent variations thereof are possible without departing from the spirit or scope of the present invention.

What is claimed is:

1. A method for chemically modifying the surface of a carbon fibril, comprising the step of exposing said fibril to a plasma selected from the group consisting of fluorine, oxygen, ammonia, helium, nitrogen and hydrogen.

* * * * *